US009228419B1

(12) United States Patent
Orentlikherman et al.

(10) Patent No.: US 9,228,419 B1
(45) Date of Patent: Jan. 5, 2016

(54) ACOUSTIC METHOD AND DEVICE FOR FACILITATION OF OIL AND GAS EXTRACTING PROCESSES

(71) Applicants: Isaak Orentlikherman, Moscow (RU); Yevgeny B. Levitov, San Antonio, TX (US); Ernest Orentlikherman, Moscow (RU)

(72) Inventors: Isaak Orentlikherman, Moscow (RU); Yevgeny B. Levitov, San Antonio, TX (US); Ernest Orentlikherman, Moscow (RU)

(73) Assignee: WELL-SMART TECHNOLOGIES—GLOBAL, INC, Reno, NV (US)

( * ) Notice: Subject to any disclaimer, the term of this patent is extended or adjusted under 35 U.S.C. 154(b) by 0 days.

(21) Appl. No.: 14/508,081

(22) Filed: Oct. 7, 2014

Related U.S. Application Data

(63) Continuation-in-part of application No. 14/218,533, filed on Mar. 18, 2014, now Pat. No. 8,881,807.

(51) Int. Cl.

| | |
|---|---|
| ***E21B 43/17*** | (2006.01) |
| ***E21B 43/00*** | (2006.01) |
| ***E21B 43/25*** | (2006.01) |
| *E21B 43/16* | (2006.01) |
| *E21B 49/00* | (2006.01) |
| *E21B 28/00* | (2006.01) |

(52) U.S. Cl.
CPC ..... *E21B 43/003* (2013.01); *E21B 43/25* (2013.01); *E21B 28/00* (2013.01); *E21B 43/162* (2013.01); *E21B 49/006* (2013.01)

(58) Field of Classification Search
CPC ... E21B 49/006; E21B 49/162; E21B 43/003; E21B 43/17; E21B 28/00
USPC ..... 166/177.1, 177.2, 268, 249
See application file for complete search history.

(56) References Cited

U.S. PATENT DOCUMENTS

| | | | | |
|---|---|---|---|---|
| 5,282,508 | A * | 2/1994 | Ellingsen et al. | 166/249 |
| 5,449,249 | A * | 9/1995 | Husten | 210/170.07 |
| 5,660,231 | A * | 8/1997 | Belonenko | 166/249 |
| 5,886,255 | A * | 3/1999 | Aronstam | 73/152.01 |
| 5,984,578 | A * | 11/1999 | Hanesian et al. | 405/128.2 |
| 6,456,566 | B1 * | 9/2002 | Aronstam | 367/86 |
| 6,662,899 | B2 * | 12/2003 | Norris et al. | 181/102 |
| 6,747,914 | B2 * | 6/2004 | Aronstam | 367/31 |
| 7,350,567 | B2 * | 4/2008 | Stolarczyk et al. | 166/249 |
| 7,628,202 | B2 * | 12/2009 | Meyer | 166/249 |
| 8,881,807 | B1 * | 11/2014 | Orentlikherman et al. | 166/249 |
| 2005/0098314 | A1 * | 5/2005 | Pope et al. | 166/249 |
| 2014/0332206 | A1 * | 11/2014 | Hallundbæk | 166/249 |

* cited by examiner

*Primary Examiner* — Kenneth L Thompson
(74) *Attorney, Agent, or Firm* — Nadya Reingand

(57) ABSTRACT

A method for improving and maintaining well productivity is disclosed. The method comprises placing at least two acoustic devices within key wells of a geological formation, measuring parameters for initial acoustic impact, and continuing to measure parameters in order to change impact parameters during production and optimize the acoustic effect. The method may be used to restore, maintain, or increase the productivity of an entire geological formation (oil or gas), and to reduce the water cut in the formation.

17 Claims, 3 Drawing Sheets

ACOUSTIC METHOD AND DEVICE FOR FACILITATION OF OIL AND GAS EXTRACTING PROCESSES

CROSS-REFERENCE TO RELATED APPLICATIONS

This patent application is a Continuation-in-Part of U.S. patent application Ser. No. 14/218,533 filed on Mar. 18, 2014, incorporated herein by reference in its entirety.

FIELD OF THE INVENTION

This invention relates to the oil and gas industry and the optimization of oil and gas recovery rates from a geological formation, resulting in increased oil and gas recoverable reserves, stable, increased oil production, and reduced water cut.

BACKGROUND OF THE INVENTION

Currently, there exist several different methods for impacting a formation to facilitate the production processes of oil and gas, including several chemical methods, which are the methods most widely used.

Currently used methods, however, have a host of disadvantages, including but not limited to the following:

1. Low impact selectivity. For example, insulation procedures on a washed formation can lead to the sealing of effectively working sub-layers.
2. Shallow reagent penetration depth into a formation.
3. Significant adsorption of many reagents, for example SAS, leading to unnecessarily high reagent losses and increased costs.
4. Increased environmental risks.
5. High overall cost.

The closest analog to the proposed invention is RF Patent No. 2143554, entitled ACOUSTIC METHOD FOR IMPACTING A WELL, which includes treating the well using an acoustic field with the goal of restoring filtration ability in the bottom zone. The process, however, only applies to one well, improving productivity in only one area.

In general, during oil (or gas) field maintenance, water delivery may be used through the system to support stratum pressure. A problem associated with such systems is muddling of the bottom hole zone, which lowers injected water volume and disregulates efficient water delivery into the formation. There exists a need to clean and keep the bottom hole zone from muddling, to restore fluid conductivity of well systems, and to increase well injectivity. There also exists a need for improving the productivity of more than one area of a well field or formation, or the field or formation in its entirety. The present invention addresses these needs.

SUMMARY OF THE INVENTION

The present invention discloses a method for restoring, maintaining, and/or increasing the productivity of a geological formation (oil or gas) or reducing a water cut in that formation. The method comprises: positioning at least two acoustic devices, each being placed in a different key well of a hydrodynamically connected system located within the geological formation, and performing an acoustic processing within each key well by the acoustic devices, which causes an acoustic impact on the entire geological formation rather than any single well.

In some aspects, the method comprises using a wireless acoustic device. In other aspects, the acoustic device may be wired or any other known type.

In some aspects, at least one of the key wells is an injection well. In some aspects, at least one of the key wells is a production well.

In some aspects, the method further comprises the steps of measuring the initial formation parameters before the acoustic processing, and setting up initial functioning parameters of each acoustic device based on the measured formation parameters.

In some aspects, the method further comprises the steps of measuring the formation parameters during the acoustic processing, and optimizing at least one functioning parameter of the acoustic devices based on the measured formation parameters in order to achieve maximum productivity and movement (this may be performed, for example, via a feedback loop installed within the well system).

In some aspects, the measuring is performed constantly. In some aspects, the measuring occurs at predetermined intervals.

In some aspects, the functioning parameters of the acoustic devices comprise a pulse shape of an acoustic signal. In some aspects, the functioning parameters of the acoustic devices comprise a frequency of an acoustic signal. In some aspects, the functioning parameters of the acoustic devices comprise a power level of an acoustic signal.

In some aspects, the method further comprises the steps of changing at least one functioning parameter of the acoustic devices to achieve one or more resonant oscillations in a perforated well bore zone of the formation.

In some aspects, the method further comprises the step of processing the measured formation parameters manually using a computer. In some aspects, the method comprises processing the measured formation parameters automatically. In some aspects, the automatic processing is performed by microcontrollers mounted on the acoustic devices.

In some aspects, the optimizing of the acoustic device functioning parameters is performed automatically via a wireless control unit. In some aspects, the optimizing of the acoustic device functioning parameters is performed automatically via a wired control unit.

In some aspects, the optimizing of the acoustic device functioning parameters is performed until a cessation of a growth rate of the formation's productivity. In some aspects, the optimizing of the acoustic device functioning parameters is performed until a termination of a change in the water cut. In some aspects, the optimizing of the acoustic device functioning parameters is performed until reservoir productivity reaches a substantially increased stable level.

DETAILED DESCRIPTION OF THE PREFERRED EMBODIMENT

Figure 1:
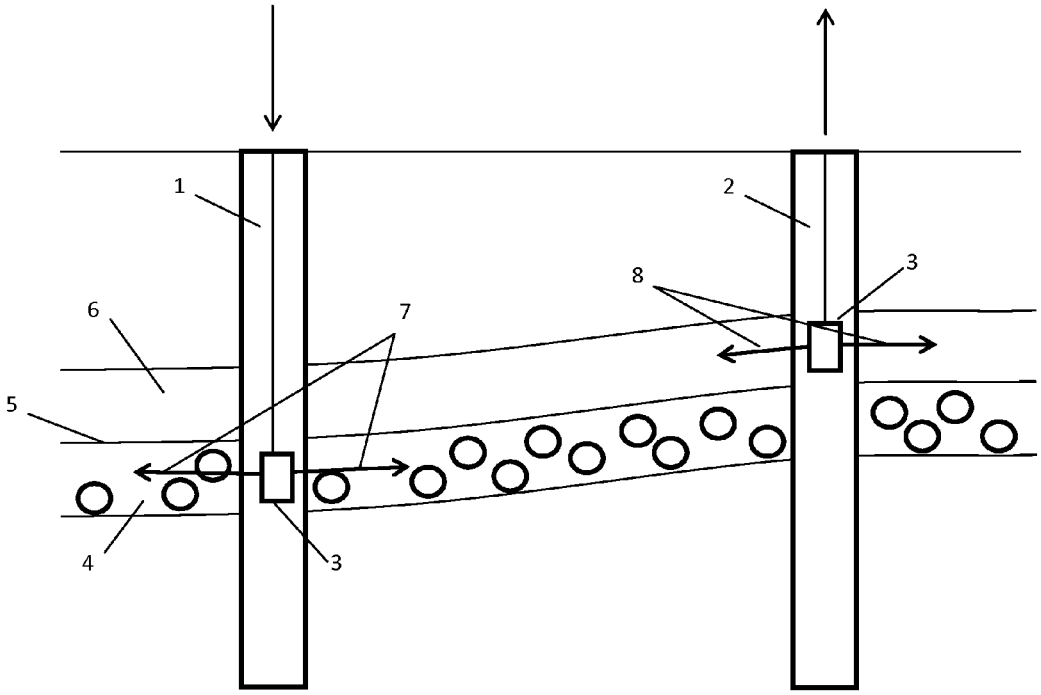
FIG. 1 shows a side cross-sectional view of one embodiment of the present invention.

The present invention improves upon the prior art by performing acoustic treatment in at least two areas of a well field or well system. Treatment (i.e. acoustic processing) of two or more key wells (or key well areas) increases productivity and decreases the water component (water cut) of entire oil or gas fields, affecting even those wells which are not directly treated. The present invention further improves upon the prior art by including a feedback loop method for evaluating and re-evaluating the effect of an acoustic impact from multiple devices in multiple wells. The feedback loop further gives an ability to optimize operation parameters without stopping the welling process or the acoustic process.

The present invention may be used to increase formation productivity by improving hydrodynamic connection(s) between wells by restoring and optimizing the filtration characteristics of the bottom-hole zone of a well or well system. The method comprises causing a synergistic effect from acoustic fields (at least two) on the well bore zones of at least an adjacent pair of injection and/or production wells or any group of connected wells. The effect of the acoustic fields is apparent on site (i.e. near the acoustic device creating the effect) as well as throughout an entire formation or well field. "Adjacent pair," as used herein, is defined as a pair of any type of well (i.e., one production well with one injection well, two production wells, two injection wells, and any combination thereof). The term "pair" does not limit, in any way, the number of wells which may be hydrodynamically connected and acoustically process, as described herein. The setup may include 3 total wells, wherein one is an injection well and two are production wells, or wherein one is a production well and two are injection wells (or 4, 5, 6 total wells, etc.). The only constraint on the combinations of types and amounts of wells is on the physical possibility for the existence of hydrodynamic connections between actual wells (i.e., any hydrodynamically connected well system improves by employing the present invention).

Devices employed by the method of the present invention may be wired, wireless, or any other. The devices used for acoustic processing (at least two: one for positioning within each of the at least two wells) are further selected based on the analysis of the hydrodynamic relationship between injection and production for specific well groups and for the formation as a whole. Wells having a hydrodynamic relationship are connected via channels and/or capillaries located beneath the ground. Any change in the parameters of a well with a hydrodynamic connection to another well will, in turn, affect the parameters of other wells via the hydrodynamic connection. For example, if after acoustic treatment, an injection well experiences increased hydrodynamic pressure, this will increase production in any hydro-dynamically connected production well(s). The feedback loop included in the method will record information regarding production and the formation, allowing for optimization of process parameters for best production results.

Figure 2:
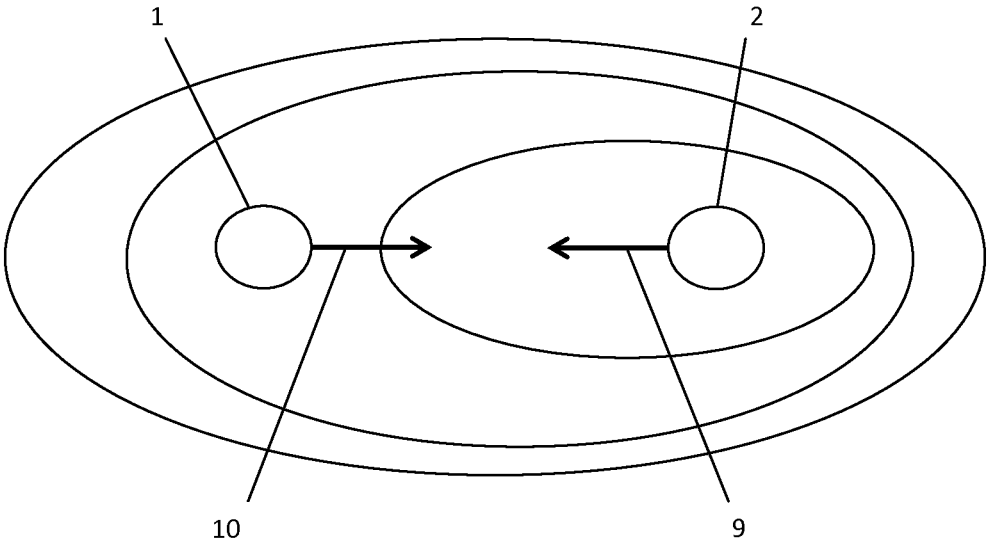
FIG. 2 shows a top view of one embodiment of the present invention.

Acoustic processing (i.e., a dynamic acoustic effect, achieved by one or more acoustic devices positioned within the well) may begin simultaneously in both wells of a hydrodynamically connected group of wells. Alternatively, those wells selected from the injection group may first be processed acoustically to redistribute the injection profile of the displacing agent. And subsequently, the corresponding production wells are processed acoustically with the aim of changing filtration stream directions in adjacent formation zones. Acoustic processing is carried out using several frequency bands, which are selected based on the filtration capacity characteristics of a particular interval, and is further optimized by adjusting the processing parameters based on data collected during the initial stage. The acoustic impact may either be continuous or be performed at calculated intervals of time. (FIG. 1, FIG. 2)

Well perforation intervals are processed acoustically point-by-point within each well and selectively in zones of elevated filtration resistance, which may be determined, for example, by preliminary geophysical investigations. Processing parameters may be corrected on the basis of data obtained and analyzed during the initial stages of processing as well as any later stage, if parameters change, or as otherwise needed.

In order to correct processing parameters, it is necessary to evaluate the fluid mobility in the porous channels during the acoustic impact via formation parameters such as length and capacity. In other words, it is necessary to identify parts of the formation where the stationary fluid is located, and, accordingly, to determine zones for application of the aforementioned method. The formation parameters monitored include but are not limited to the following inputs/information, collected during the well drilling process, measured by geophysical instruments, and/or calculated based on geophysical research and measurements:

1. Porosity (measured in percentage, based on geophysical information);
2. Permeability (measured in mD (mDarcy);
3. Bottom-hole pressure (direct measurement, in atm);
4. Formation pressure in well zones (direct measurement, in atm);
5. Downhole temperature (direct measurement, in C.° or F.°);
6. Clayiness (i.e., clay percentage) (measured in percentage, based on geophysical information);
7. Current oil saturation of rock formation (measured in percentage, based on geophysical information);
8. Stratum pressure (direct measurement, in atm); and
9. Dynamic viscosity under current conditions (measured in mPa's).

Figure 3:
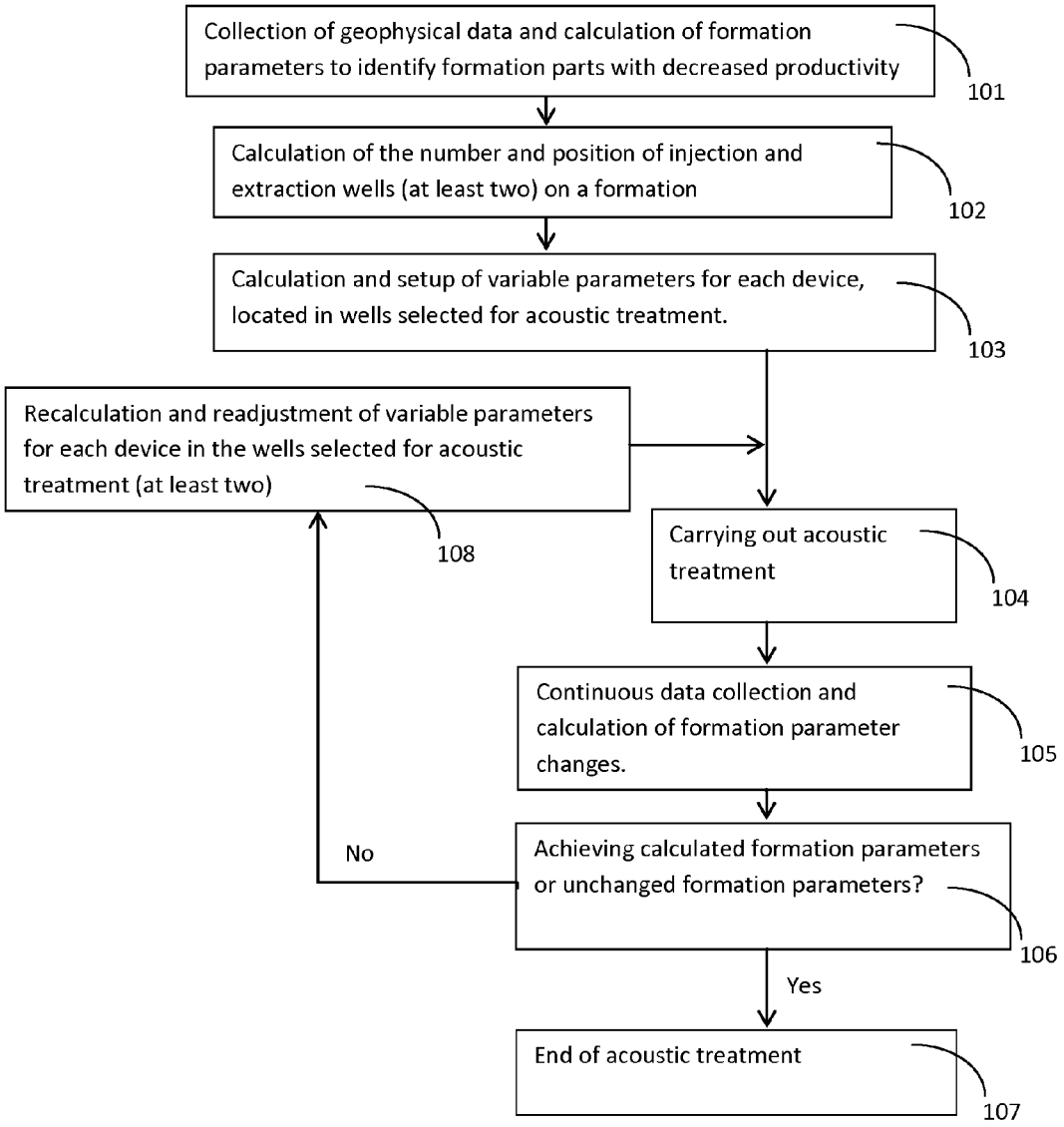
FIG. 3 is a flowchart detailing one embodiment of the method of the present invention.

The method comprises continuous or periodic synergistic formation treatment with process repetition to achieve and maintain an improved or stabilized water cut during production, increased oil production due to changes in input parameters, and, as a result, a greater coefficient of oil or gas production (FIG. 3). The present method leads to increased recoverable reserves of oil or gas in a formation.

The present invention also discloses a methodical technological system designed based on an effect on individual wells, but configured to work not just on individual wells but for the whole formation.

The disclosed system and method accomplish the following objectives:

1. Regulating the process of developing the resource deposit by controlling the discharge front.
2. Identifying formation parts with poor filtration and high residual oil or gas reserves, and including those parts in the filtration process.
3. Identifying and including poorly-draining formations in the filtration process.
4. Continuously controlling the parameters of the acoustic impact process as well as changing parameters of the fluid in the bottom-hole zone while recording data regarding the changing parameters of the fluid and/or formation into a database for further analysis.
5. Automatically or manually changing the acoustic impact parameters on the basis of the above-mentioned recorded data, with the aim of optimizing the acoustic impact.

The proposed invention is unique for the following reasons. Acoustic treatment of an individual well results in changes to the filtration properties of its bottom zone. In the case of treating a single well, depending on the specified objective, the result will be either redistribution of the filtration profile, increased injection/flow rate, or both simultaneously. The stated effects permit an increase in oil production.

However, in the case of separate or individual processing of spatially isolated and hydrodynamically isolated wells, the effect from the separate or individual impact on the formation as a whole is not strong enough. The impact on the specific area of the formation, however, can lead to an increased oil or gas production rate and as a result, increased recoverable reserves from that particular area. The present invention provides a method for impacting various parts of a formation, or the formation as a whole, rather than just one specific area, thus having applicability in treating hydro-dynamically connected well systems.

The present invention provides highly selective impacts, low costs, ease-of-use, and complete environmental safety. The present invention is free from the aforementioned disadvantages of known methods for impacting formations. The invention may additionally be implemented in conjunction with known chemical methods in order to raise their effectiveness by increasing reagent penetration depth into a formation.

The present invention increases oil formation productivity, achieved due to the following mechanisms. The invention comprises an impact on a formation by acoustic treatment of two or more adjacent wells, the acoustic effects determined based on formation and oil/gas field analyses. The redistribution of filtration profile flow rates on both ends of the oil or gas stream in the formation (production and injection wells) leads to redistributed streams inside the formation due to changes in the direction and magnitude of pressure gradients. As a result, formation coverage is increased by the flooding process and previously bypassed oil or gas is now included in the filtration process. The technological manifestation of this effect is an increased oil or gas displacement rate, improved or stabilized water cut during production, and/or a cessation of water cut growth, accompanied by an increased recovery of oil or gas. Additionally, the acoustic field produced weakens interphase surface interaction, which leads to decreased fluid viscosity and involvement in the filtration process of volumes of fluid that were previously stationary within the pore radius, under existing development conditions. As a result of the synergistic treatment of a well group according to specified intervals, movement of oil or gas is activated in gas-saturated or oil-saturated sub-layers having poor permeability. The stated mechanisms facilitate control of the displacement agent injection front and thus regulate development of the resource deposit. The end result of implementing this method is an increased oil or gas production coefficient.

The proposed method may be implemented in the following way:

Based on analysis of field data on the distribution of formation pressure, oil or gas recovery, water cut, and injection, formation zones with deteriorating hydrodynamic connections between wells or breaches in the injection front are determined and selected. Maps are created of fluid streams inside selected zones.

Results of geophysical studies of the selected well zones are then analyzed, wherein the analysis is used to determine the frequencies and power of acoustic treatments, key wells, and the time intervals for treating wells or the length of acoustic impact. A calculation of frequency-power parameters of the treatment is performed, depending on the petrophysical properties of the selected zone's formation. The well treatment sequence, with the goal of redistributing hydrodynamic streams, is then determined. If the wells are hydrodynamically connected, the acoustic treatment is conducted simultaneously. Alternatively, the injection group may be treated first, then after a short interval, the production well is treated (according to the fluid stream map). To control the injection front, a corresponding production well may be treated after an estimated time, required for formation pressure relaxation, following treatment of the injection wells.

Treatment (i.e. acoustic processing) of the individual wells occurs according to the acoustic treatments disclosed in RF Patent No. 2143554 or any other known method for performing an acoustic treatment. The equipment, by means of which the treatment is performed, may comprise any known equipment in the art today, including but not limited to that disclosed in U.S. Patent Application No. 2014/218533 and Russian Patent Nos. RF 2164829, filed 6 Sep. 2000, and RF 2134436, filed 6 Oct. 1999.

In the proposed invention, the acoustic impact is upgraded to improve acoustic impact effectiveness on separate wells and the formation as a whole by means of continuous parameter control of the acoustic impact, fluid parameter changes in the bottom zone, and the continuous recording of the parameter data and any changes/variation into a database in order to optimize the process after initiation.

Automatic or manual changes in acoustic impact parameters are made based on the data indicated above with the aim of optimizing the acoustic impact.

It is necessary to determine the initial setup of the acoustic field in order to include stationary fluid in the filtration process, which will in turn determine the direction "towards" or "against" the pressure gradient ("from" the well, where the acoustic device is placed or "towards" the well), as well as the amount of fluid involved in filtration. The acoustic treatment causes an effect "towards" the pressure gradient for injection wells. And for production wells, the treatment causes an effect "against" the pressure gradient. In both cases, the acoustic device is located inside the well. See attached (FIG. 3).

The present invention comprises the following steps (FIG. 4 shows a data processing flow chart for this one embodiment of the system and method for optimization of an acoustic impact on a formation, in automatic or manual mode):

1. Collection of geophysical data to meet initial criteria for required treatment and calculation of formation parameters to identify those formation parts, or areas, which are decreasing productivity (for example, based on a chart of the speed of production decline; a higher speed of production decline would suggest a need for treatment) 101;

2. Determination of the number and position of key injection and production wells (at least one adjacent pair of wells, or any greater amount of connected wells) on a formation 102;

3. Calculation and setup of variable parameters for each device, to be positioned in wells selected for acoustic treatment. Using the input parameters and criteria for acoustic impact optimization, the initial equipment setup is determined for the given resource deposit conditions 103;

4. Carrying out acoustic treatment 104;

5. Continuous data collection and calculation of formation parameter changes as acoustic treatment continues 105;

6. Determination whether the treatment and setup parameters are either achieving the desired formation parameters or maintaining formation parameters 106;

7. Recalculating and adjusting (i.e. optimizing) of the variable setup parameters for each device in the wells selected for acoustic treatment (at least two devices in at least two wells) when desired formation parameters are not achieved or maintained 108 (feedback loop); and 8. Ending or continuing with acoustic treatment when desired formation parameters are achieved or maintained 107.

The information obtained is measured continuously, digitized, processed, and optimized, correcting the initial setup of acoustic devices in order to increase gas or oil production. Thus, equipment operates in automatic mode and takes into account acoustic impact optimization. The main setup parameters of the acoustic equipment, which are further adjusted during optimization of the process, are:

1. Power (acoustic pressure);
2. Frequency;
3. Signal pulse shape.

Analysis of the formation condition and the complex well treatments according to the proposed method on the identified currently ineffective formation zones occurs continuously, based on information being obtained and noted formation changes. Such repetition of treatments allows stabilization or reduction of the rate of water cut increase for the duration of the formation development, maintaining stable oil production from the sub-layers with low permeability, resulting in an increased oil production coefficient and increased recoverable reserves (FIG. 3).

The setup for one embodiment of the presently claimed system and method may be as follows (see FIGS. 1 and 2):

Two acoustic devices 3 are positioned within a particular well (key well) within a system of wells. In this example, the two wells form an adjacent pair of wells, one being an injection well 1 and the other being a production well 2. In the injection well 1, an acoustic device 3 is positioned at or nearby the water layer 4 of the well system, such that the acoustic processing creates an impact on the water layer to increase the water injection rate 7, 10. In the production well, a second acoustic device 3 is positioned at or nearby the oil (or gas) layer 6 of the well system, such that the acoustic processing creates an acoustic impact directed towards the bottom hole formation zone 8, 9, in order to increase the oil stream and thus oil production (and extraction). The water layer 4 and the oil/gas layer 6 maintain contact at the water-oil contact layer 5, where the water and oil exist in mixed form. FIG. 1 shows acoustic impacts 7, 8 directed in both directions at both wells, in the case that additional wells are connected to the two shown in the illustration. Essentially, the acoustic devices 3 may be programmed to create any dynamic acoustic impact in any direction desired, based on the desired effects on well productivity and function.

The description of a preferred embodiment of the invention has been presented for purposes of illustration and description. It is not intended to be exhaustive or to limit the invention to the precise forms disclosed. Obviously, many modifications and variations will be apparent to practitioners skilled in this art. It is intended that the scope of the invention be defined by the following claims and their equivalents.

Moreover, the words "example" or "exemplary" are used herein to mean serving as an example, instance, or illustration. Any aspect or design described herein as "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

What is claimed is:

1. A method for restoring, maintaining, or increasing oil or gas productivity of a geological formation or reducing a water cut in the formation, comprising:

positioning at least two electrical acoustic devices, each within a different key well of a hydrodynamically connected system located within the geological formation, and performing an acoustic treatment within each key well by said at least two acoustic devices, sending acoustic waves from each device via liquid medium in the hydrodynamically connected system, thus causing a destructive acoustic impact on the entire geological formation; measuring formation parameters during the acoustic treatment, and optimizing at least one functioning parameter of the acoustic devices based on the measured formation parameters; wherein the acoustic treatment is automatically controlled by microcontrollers mounted on the acoustic devices; and restoring, maintaining, or increasing oil or gas productivity of a geological formation or reducing a water cut in the formation due to the acoustic impact.

2. The method according to claim 1, wherein at least one acoustic device is a wireless acoustic device.

3. The method according to claim 1, wherein at least one of the key wells is an injection well.

4. The method according to claim 1, wherein at least one of the key wells is a production well.

5. The method according to claim 1, further comprising the steps of: measuring initial formation parameters before the acoustic treatment, and setting up initial functioning parameters of each acoustic device based on the measured formation parameters.

6. The method according to claim 1, wherein the measuring is constant.

7. The method according to claim 1, wherein the measuring occurs at predetermined intervals.

8. The method according to claim 1, wherein the functioning parameters of the acoustic devices comprise a pulse shape of an acoustic signal.

9. The method according to claim 1, wherein the functioning parameters of the acoustic devices comprise a frequency of an acoustic signal.

10. The method according to claim 1, wherein the functioning parameters of the acoustic devices comprise a power of an acoustic signal.

11. The method according to claim 1, further comprising the step of: changing at least one functioning parameter of the acoustic devices to achieve a resonant oscillation in a perforated well bore zone of the formation.

12. The method according to claim 1, further comprising the step of: treatment the measured formation parameters manually using a computer.

13. The method according to claim 1, wherein the optimizing of the acoustic device functioning, parameters is performed automatically via a wireless control unit.

14. The method according to claim 1, wherein the optimizing of the acoustic device functioning, parameters is performed automatically via a wired control unit.

15. The method according to claim 1, wherein the optimizing of the acoustic device functioning parameters is performed until a cessation of a growth rate of the formation's productivity.

16. The method according to claim 1, wherein the optimizing of the acoustic device functioning parameters is performed until a termination of a change in the water cut.

17. The method according to claim 1, wherein the optimizing of the acoustic device functioning parameters is performed until reservoir productivity reaches a substantially increased stable level.

* * * * *